US005213429A

United States Patent [19]

Johnson

[11] Patent Number: 5,213,429

[45] Date of Patent: May 25, 1993

[54] FOLDABLE RING BINDER-FOLDER

[76] Inventor: Noble T. Johnson, 492 Wold Dr., Mt. Clemens, Mich. 48045

[21] Appl. No.: 893,710

[22] Filed: Jun. 5, 1992

[51] Int. Cl.[5] ..... B42F 3/00; B42F 13/02; B42F 13/06; B42F 13/10

[52] U.S. Cl. ..... 402/8; 402/13; 402/80 R; 402/80 P; 402/75

[58] Field of Search ..... 402/8, 79, 80 R, 80 P, 402/75, 13

[56] References Cited

FOREIGN PATENT DOCUMENTS

| | | | |
|---|---|---|---|
| 646664 | 8/1964 | Belgium | 402/80 R |
| 3005878 | 8/1981 | Fed. Rep. of Germany | 402/80 R |
| 407946 | 9/1966 | Switzerland | 402/8 |
| 2236280 | 4/1991 | United Kingdom | 402/8 |

*Primary Examiner*—Paul A. Bell
*Attorney, Agent, or Firm*—Peter D. Keefe

[57] ABSTRACT

A hybrid binder-folder utilizing a foldable ring system for holding pages, which affords the advantage of easy page manipulation of ring binders with the advantage of flat folding of folders. The binder-folder has two side members which are mutually foldable along the centerline therebetween. Two, three or more foldable rings of flat, thin cross-section and of substantially semicircular shape are connected with the side members adjacent with and transverse to the centerline. When the two side members are mutually folded closed, the foldable rings fold along three folds: adjacent each connection with the two side members and at the ring apex. As a result of this foldability feature, the foldable rings are able to flatly fold, thereby permitting the binder-folder to be substantially flat when closed. When the side members are folded open, the rings unfold along the three folds to become substantially semicircularly shaped rings for guiding pages trapped on the foldable rings in the manner of a conventional ring binder. Removal and insertion of pages with respect to the foldable rings is achieved by a ring connection mechanism which is releasable with respect to one or both of the side members of the binder-folder, or else the foldable rings may be structured to be selectively openable at other than the ring apex.

20 Claims, 4 Drawing Sheets

FOLDABLE RING BINDER-FOLDER

BACKGROUND OF THE INVENTION

1. Field of the Invention

The present invention relates to page connection systems used in binders and folders. More particularly, the present invention relates to a foldable ring system of a hybrid binder-folder which permits easy page removal and insertion, arcing page movement, and thin folding of the binder-folder.

2. Description of the Prior Art

Conventional ring binders utilize two, three or more rings connected with the spine of the ring binder for holding pages, usually in the form of sheets paper. The side members of the ring binder are foldably connected with the spine, and the rings are structured to selectively open and close in order to permit page insertion and removal with respect thereto. In operation, a user would open the ring binder with the side members of the ring binder on a resting surface and the rings facing up toward the user. The rings are then opened, pages having holes punched therein are then added or subtracted from the rings and the rings are then closed. Thereafter, the pages are arcably moved on the rings in order for the user to locate a selected page. When it is time to close the ring binder, the side members are folded so that the distal ends of the side members remote from the spine come into, or nearly into, adjacency. The resulting shape is far from being flat, in that the spine must be of at least a minimal width sufficient to accommodate the diameter of the rings. Consequently, the shape of a closed ring binder is generally triangular. Thus, a ring binder is of considerable thickness when closed even if no pages are held on the rings. As a result, it would be advantageous to provide a page holder which does not suffer from having an unavoidably wide spine.

An alternative to ring binders are folders. Folders have two or more page engagement members in the form of a pair of metallic flaps which insert through a hole in the page and then are folded over flat with respect to the fold centerline of the folder. In this regard, the side members of the folder fold along the centerline and the resulting shape is substantially flat. Another advantage of folders is that the side members can be folded back on themselves, thereby making it easier to handle the folder and resulting in a minimized footprint on a desk top. While folders eliminate the spine problem of ring binders, they suffer from the pages not being as readily manipulated in the manner possible only with rings.

Therefore, what is needed in the art is a system for holding pages having the advantages of both a ring binder and a folder without the disadvantages of either.

SUMMARY OF THE INVENTION

The present invention is a hybrid binder-folder utilizing a foldable ring system for holding pages, which affords the advantage of easy page manipulation of ring binders with the advantage of flat folding of folders.

The binder-folder according to the present invention has two side members which are mutually foldable along the centerline therebetween. Two, three or more foldable rings of flat, thin cross-section and of substantially semicircular shape are connected with the side members adjacent with and transverse to the centerline. When the two side members are mutually folded closed, the foldable rings fold along three folds: adjacent each connection with the two side members and at the ring apex. As a result of this foldability feature, the foldable rings are able to flatly fold, thereby permitting the binder-folder to be substantially flat when closed. When the side members are folded open, the rings unfold along the three folds to become substantially semicircularly shaped rings for guiding pages trapped on the foldable rings in the manner of a conventional ring binder.

Removal and insertion of pages with respect to the foldable rings is achieved by a ring connection mechanism which is releasable with respect to one or both of the side members of the binder-folder, or else the foldable rings may be structured to be selectively openable at other than the ring apex.

Accordingly, it is an object of the present invention to provide a binder-folder which functions similar to a ring binder, but without a spine.

It is a further object of the present invention to provide a binder-folder which functions similar to a folder, but has rings.

It is an additional object of the present invention to provide a binder-folder having a plurality of foldable rings which are foldable so as to permit the binder-folder to be closed substantially flat.

It is another object of the present invention to provide a binder-folder that holds pages in a manner substantially similar to that of a ring binder, yet is flatly foldable in a manner substantially similar to a folder.

It is yet another object of the present invention to provide a binder-folder which permits pages to be manipulated on foldable rings when the binder-folder is open, yet is substantially flat when the binder-folder is folded closed, in which the foldable rings are selectively releasably connected with the binder-folder for permitting removal and insertion of pages with respect thereto.

It is still an additional object of the present invention to provide a binder-folder which permits pages to be manipulated on foldable rings when the binder-folder is open, yet is substantially flat when the binder-folder is folded closed, in which the foldable rings are selectively openable for permitting removal and insertion of pages with respect thereto.

These, and additional objects, advantages, features and benefits of the present invention will become apparent from the following specification.

DETAILED DESCRIPTION OF THE PREFERRED EMBODIMENT

Figure 1:
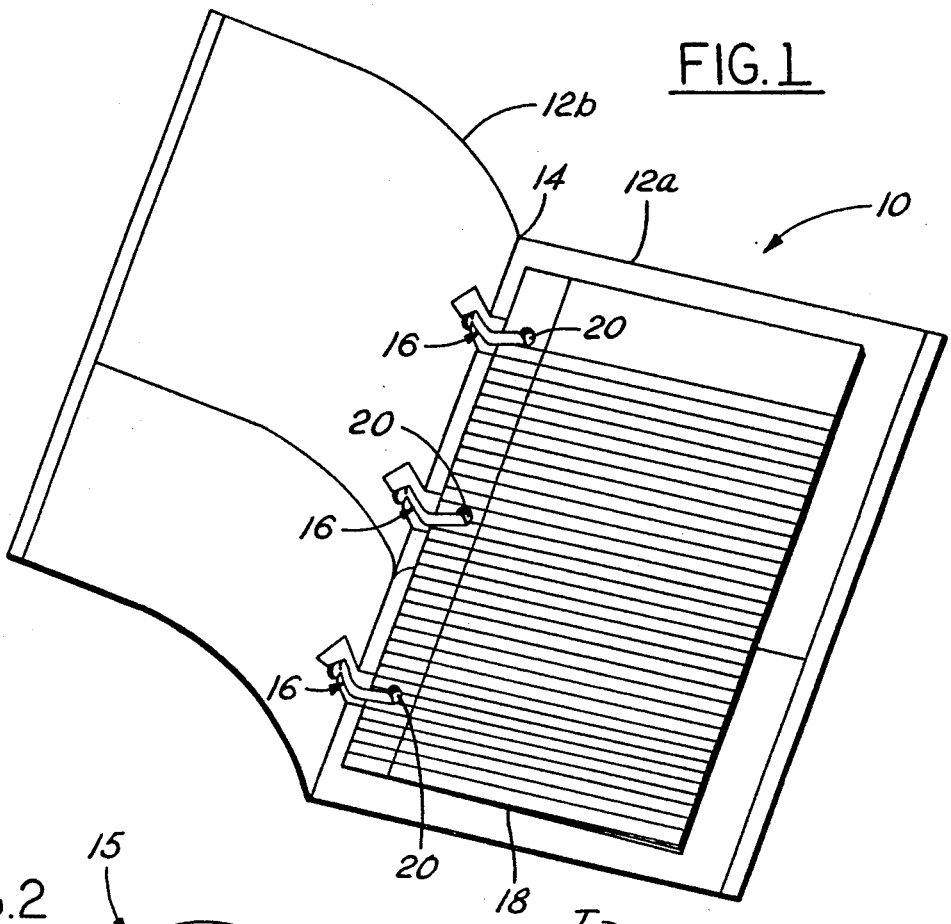
FIG. 1 is a perspective view of a binder-folder according to the present invention, shown in a substantially open orientation in operation with respect to a plurality of pages.

Referring now to the Drawing, FIG. 1 shows generally the binder-folder 10 according to the present invention. The binder-folder is composed of two side members 12*a*, 12*b* which are mutually foldably connected together along a centerline fold 14. The binder-folder 10 is further composed of a plurality of foldable rings 16 connected with the side members 12*a*, 12*b* for interconnecting with pages 18 via the respective holes 20 thereof. Because the foldable rings 16 are not rigid, they may fold from a semi-circular shape into a collapsed flat shape. Accordingly, there is no need for a spine. As a result of this structure, the binder-folder 10 has a ring binder-like page manipulation advantage, as well as a folder-like centerline folding advantage which permits it to be of a generally flat shape when closed and further permits it to be folded back on itself, thereby making it easier to handle and to have a minimized footprint on a desk top.

The side members 12*a*, 12*b* are constructed of rigid, semi-rigid or flexible materials commonly used in conventional ring binders and folders. The dimension of the side members 12*a*, 12*b* is predetermined to protectively cover the pages 18 in the manner of a ring binder or folder. The centerline fold 14 is positioned medially with respect to the two side members 12*a*, 12*b*, and it is preferred, but not required, that the two side members be mutually integral. Alternatively, for instance, the two side members 12*a*, 12*b* could be hingably interconnected, in which case the centerline fold 14 operates by means of a hinge, such as a piano hinge.

Figure 2:
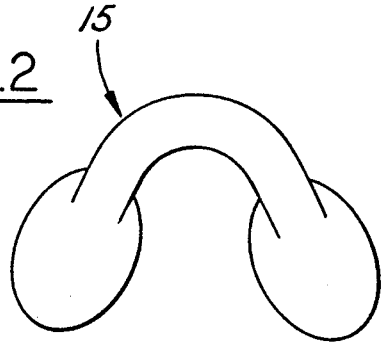
FIG. 2 is a top plan view of a foldable ring according to the present invention die cut from a plastic sheet stock.

FIG. 2 depicts a preferred method of forming the foldable rings 16 via die cutting of a plastic sheet stock material into a piece 15, as shown. The die cut piece 15 is then provided with folds memorized by the material to form the foldable ring 16 shown in FIG. 3.

Figure 3:
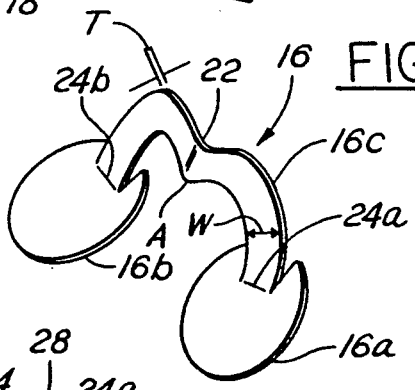
FIG. 3 is a detail perspective view of a foldable ring according to the present invention.

It is seen in FIG. 3 that the foldable ring 16 includes a ring portion 16*c* and an integrally connected foot portion 16*a*, 16*b* at either end of the ring portion. The ring portion 16*c* is of a generally semi-circular shape when unfolded, having an apex A. The ring portion 16*c* preferably has an apex fold 22 which is memorized by the material of which the foldable ring 16 is constructed. The material is preferred to be a durable, flexible, substantially nonstretchable plastic, although other materials may be used. As can be discerned from FIGS. 1 and 3, the foldable rings 16 are dimensioned so as to have a ring diameter similar to that of the rings used in conventional ring binders, on the order, for example, of one-half to two inches. The foldable rings 16 are thinly constructed. That is, the thickness T is preferred to be at least an order of magnitude less than the width W, although this is not a requirement. In this regard, the thickness T should be thin and uniformly flat so that the foldable ring 16 can flatly fold so as to occupy very little cross-sectional space, and the width W should be on the order of just less than the hole diameter of the pages so that the pages can travel on the ring portions 16*c* in the manner customary with conventional ring binders. For example, the foldable rings 16 may have a substantially flat thickness T on the order of about five-thousandths inch, and a ring width W just under about one-quarter inch, which is a little less than the hole diameter made by a paper punch. It is further preferred for the ring portion 16*c* of each of the foldable rings 16 to include basal folds 24*a*, 24*b* memorized by the material adjacent respective foot portions 16*a*, 16*b*. The basal folds 24*a*, 24*b* and apex fold 22 combine to provide a predictable and efficient folding of the foldable rings 16 when the binder-folder 10 is closed by a user, without interference with respect to the pages 18, as will become clearer hereinbelow.

Figure 4:
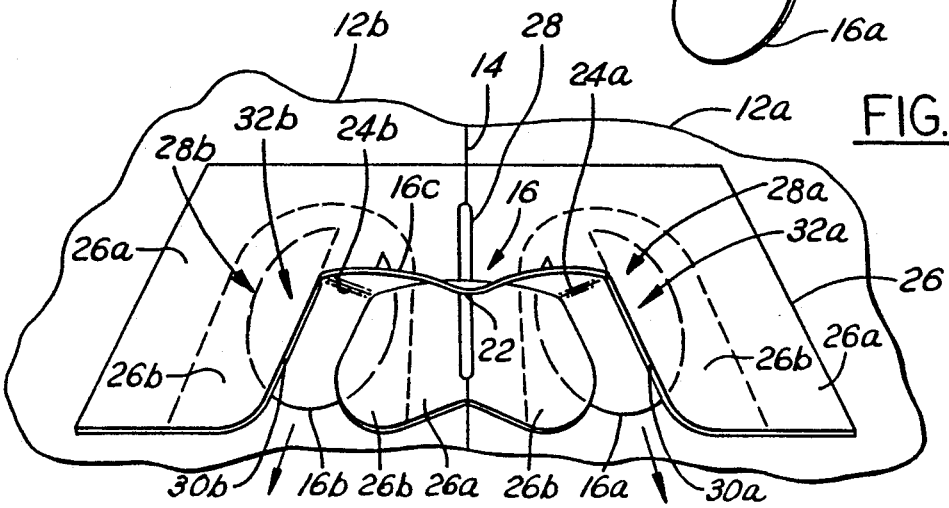
FIG. 4 is a detail perspective view of a first preferred attachment mechanism for connecting the foldable rings to the side members of the binder-folder.

As can be discerned from FIG. 4, each of the foldable rings 16 is connected with the side members 12*a*, 12*b* so that the ring portion 16*c* is oriented transverse with respect to the centerline fold 14. In this regard, one foot portion 16*a*, 16*b* is connected with a respective one of the side members 12*a*, 12*b*. In the foldable ring embodiment shown in FIG. 4, the ring portion 16*c* is a single piece unit. Thus, in order to add or remove pages 18 with respect to the binder-folder 10, one or both foot portions 16*a*, 16*b* must be selectively releasable with respect to its respective side member. This is accomplished by way of preferred example through the use of a base member 26. The base member 26 straddles the centerline fold 14 and is connected to each of the side members 12*a*, 12*b* by any conventional means, such as by adhesive G as shown in the Drawing (for paper product construction) or by sonic welding (for plastic product construction). A selected portion 26*a* of the base member 26 is connected to the side members 12*a*, 12*b*. The remainder 26*b* thereof that is not connected to the side members forms two pockets 28*a*, 28*b*. Each pocket 28*a*, 28*b* has a slot 30*a*, 30*b* which is approximately dimensioned to coincide with the foldable ring width W. The combination of each pocket with its respective slot forms pocket-slots 32*a*, 32*b*, each structured so that the ring portion 16*c* and respective foot portion 16*a*, 16*b* may slide thereinto, while the respective foot portion is interferingly trapped in the normal direction with respect thereto, as shown in FIG. 4. Since the foot portions 16*a*, 16*b* are slidable with respect to the respective pocket-slots 32a, 32b, they may be selectively removed therefrom (along the arrows in FIG. 3) and inserted thereinto (in the reverse direction) so as to permit a user to add or remove pages 18 from each foldable ring 16. In this regard, the foot portions 16a, 16b are flexible so as to be flexed and thereby inserted through the holes 20. The base member 26 may or may not include a medial cut-out 28 along the centerline fold 14 for facilitating foldability of the side members 12a, 12b along the centerline fold.

Figure 5:
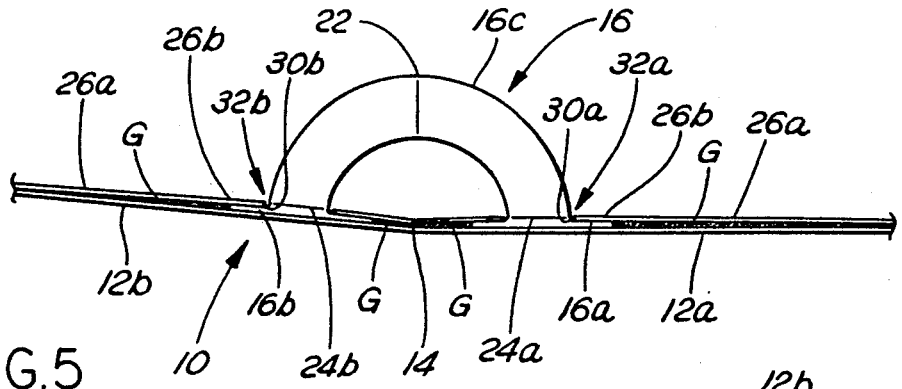
FIG. 5 is an end view of the binder-folder according to the present invention, shown in an open orientation with the foldable ring unfolded into a semi-circular ring.
Figure 6:
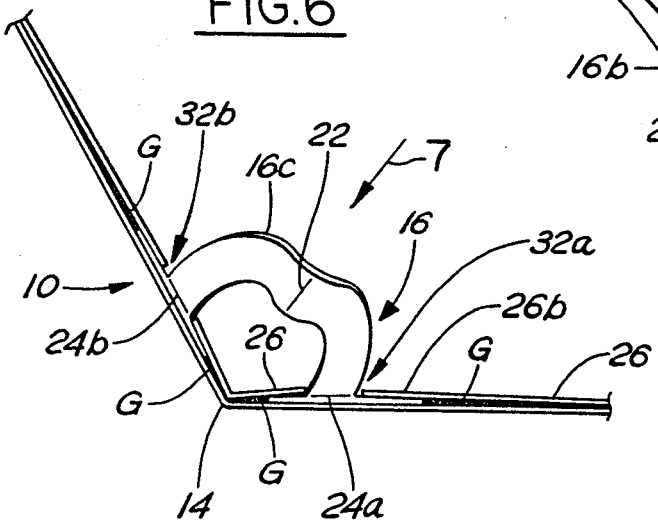
FIG. 6 is an end view of the binder-folder according to the present invention, shown in a first partly open orientation with the foldable ring partly folded.
Figure 7:
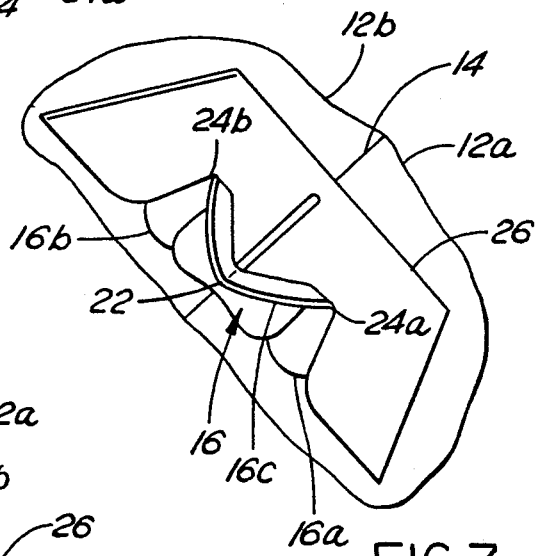
FIG. 7 is a perspective detail view seen along arrow 6 in FIG. 5.
Figure 8:
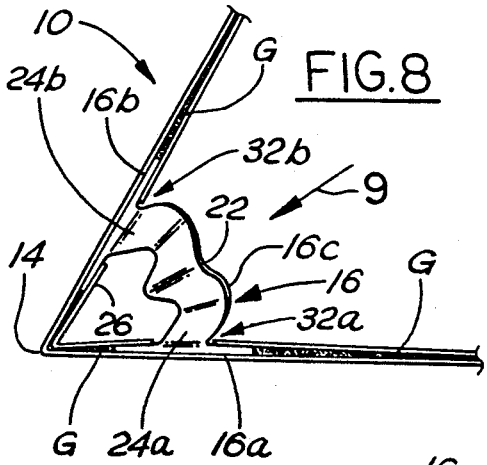
FIG. 8 is an end view of the binder-folder according to the present invention, shown in a second partly open orientation with the foldable ring folded more than that depicted in FIG. 5.
Figure 9:
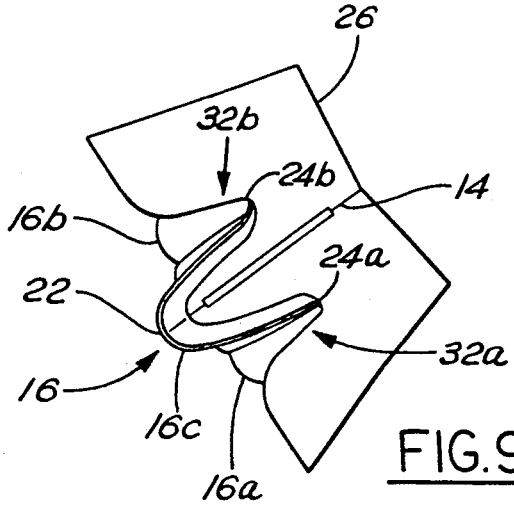
FIG. 9 is a perspective detail view seen along arrow 8 in FIG. 7.
Figure 10:
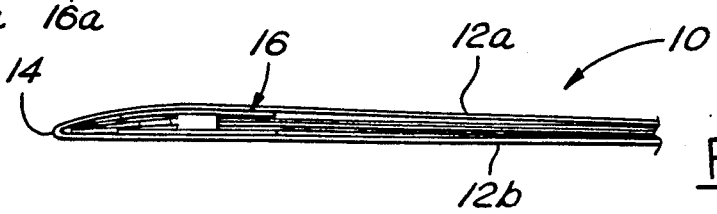
FIG. 10 is an end view of the binder-folder according to the present invention, shown in a closed orientation with the foldable ring flatly folded.

FIGS. 5 through 10 depict operation of the binder-folder 10, from an open orientation, shown in FIG. 5, to a closed orientation shown in FIG. 10, and vice versa.

As can be understood from FIG. 5, in the open orientation, the ring portion 16c of the foldable rings 16 are in the unfolded configuration so that pages can be arcably manipulated on them in the manner used with respect to conventional ring binders. Now, when it is desired to close the binder-folder 10, the binder-folder is folded along the centerline fold 14 and the foldable rings 16 fold along the apex fold 22 and the two basal folds 24a, 24b as progressively depicted in FIGS. 5 through 10, until the binder-folder is in the closed orientation, whereat the foldable rings are in the folded configuration. As can be seen in FIG. 10, the foldable rings 16 fold flatly so that the cross-section of the binder-folder is very small, similar to that of a conventional folder.

While folding along the apex fold 22 and the two basal folds 24a, 24b is preferred, this is not a requirement, as any sort of folding which accomplishes substantially flatly folded foldable rings similar to that shown in FIG. 10 is acceptable. Indeed, when pages 18 are present, the foldable rings 16 may not necessarily fold at the basal folds, but rather fold at an intermediate location between the basal folds and the apex fold due to the holes of the pages regulating how the foldable rings fold. However, it is preferred that the material of each foldable ring 16 have a memorized apex fold 22 and memorized basal folds 24a, 24b so that folding is predictable and efficient, with as little interference with respect to the pages as possible. In this regard, it is preferred that all foldable rings fold in the same orientation, with the basal folds folding with acutely with respect to the foot portions 16a, 16b (as shown).

Figure 11:
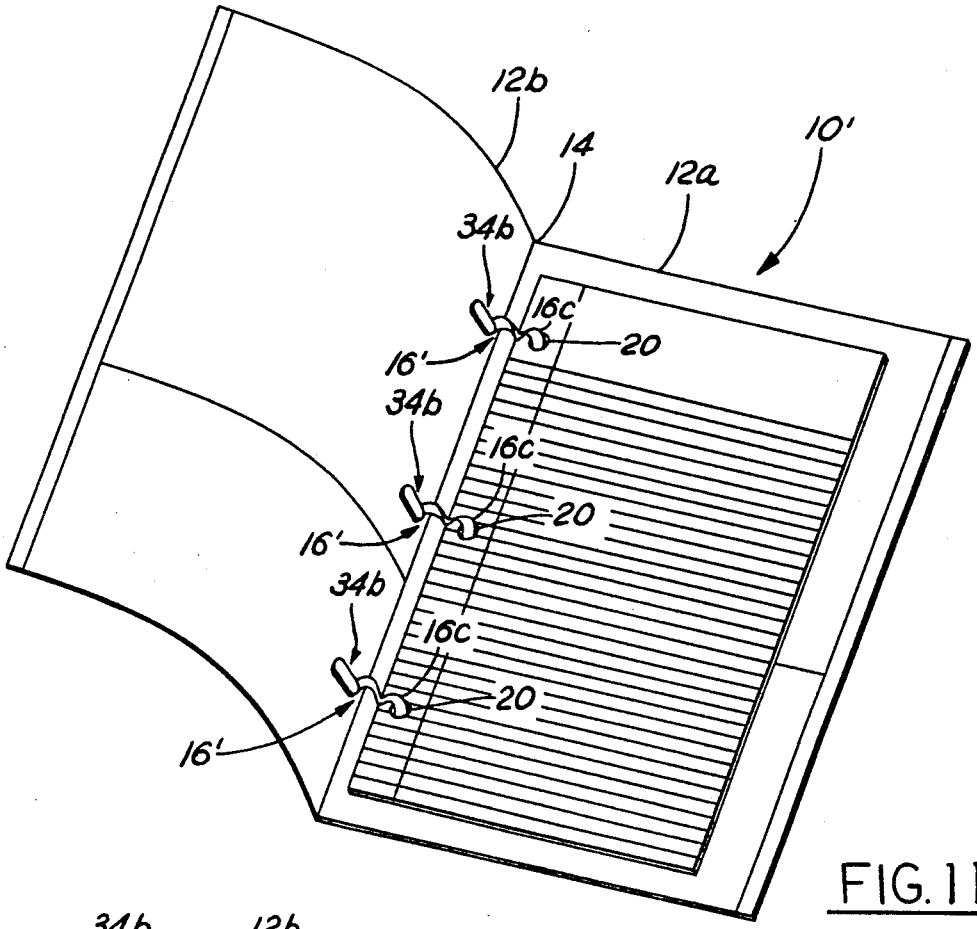
FIG. 11 is a perspective view of a binder-folder according to the present invention, shown in a substantially open orientation in operation with respect to a plurality of pages, a second foldable ring attachment mechanism being depicted.
Figure 12:
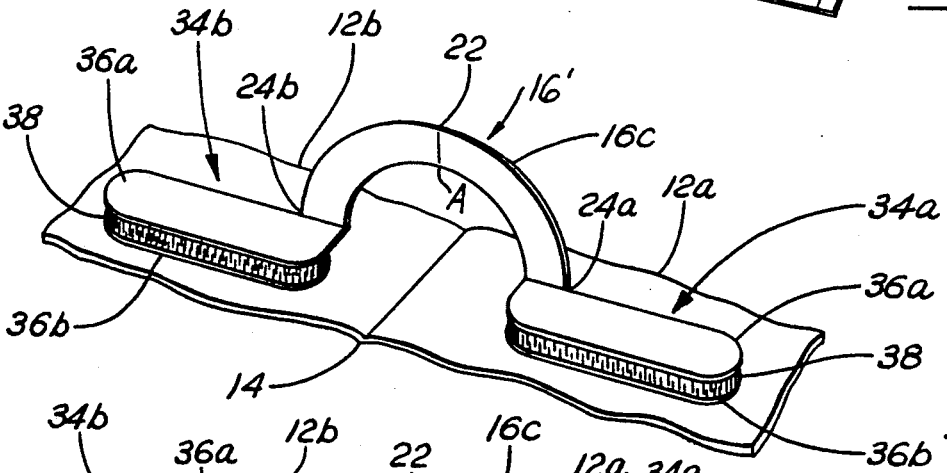
FIG. 12 is a detail perspective view of the second foldable ring attachment mechanism releasably connecting a foldable ring to the side members of the binder-folder, the binder-folder being in an open configuration.
Figure 13:
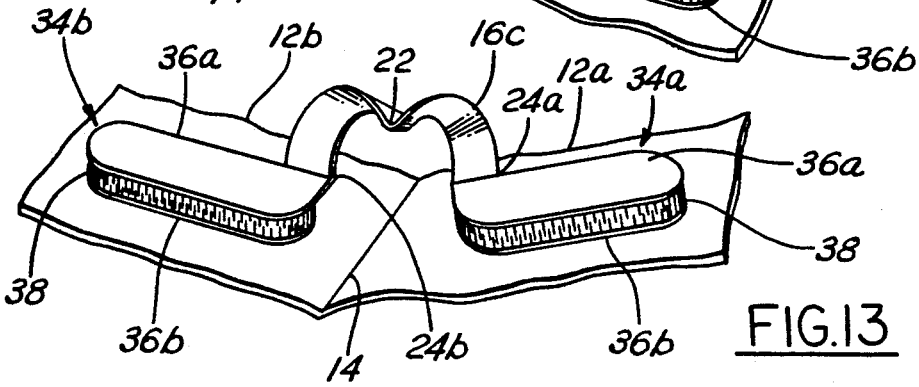
FIG. 13 is a detail perspective view of the second foldable ring attachment mechanism releasably connecting a foldable ring to the side members of the binder-folder, the binder-folder being in a partly open configuration.

Turning now to FIGS. 11 through 13, an alternative binder-folder 10' is depicted, wherein a foldable ring 16' having modified foot portions is employed. In this modification, the foldable rings 16' have the same ring portion structure 16c as in the previously discussed foldable rings 16; however, now included are modified foot portions 34a, 34b connected with either end of the ring portion 16c. The modified foot portions 34a, 34b are bifurcated into an upper half 36a and and a lower half 36b. Each lower half 36b is connected with a respective side member 12a, 12b in the manner discussed hereinabove with respect to the foot portions 16a, 16b. A two component releasable fastener 38 connects the upper and lower halves. In this regard, one component of the two component fastener is connected respectively with each upper half 36a and a second component of the two component fastener is connected respectively with each lower half 36b. A preferred releasable fastener 38 is a hook and loop fastener of the type manufactured under the trademark VELCRO.

In operation, to add or remove pages from the foldable rings 16', the user need only separate the upper and lower halves of one of the foot portions 34a or 34b so as to let the holes of the page slip through the chosen foot portion, either with respect to adding or removing pages to the foldable rings.

It is to be understood that while two preferred examples of releasable attachments of foldable rings to the side members is shown herein, there are many other equivalent structures that can be used for this purpose, and these are contemplated within the scope of the present invention.

Figure 15:
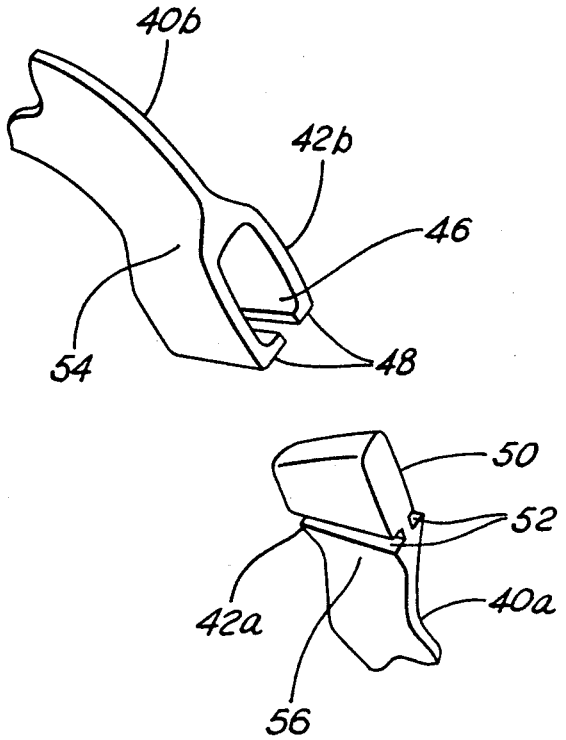
FIG. 15 is a detail perspective view of the selectively releasable ring interconnection mechanism.
Figure 14:
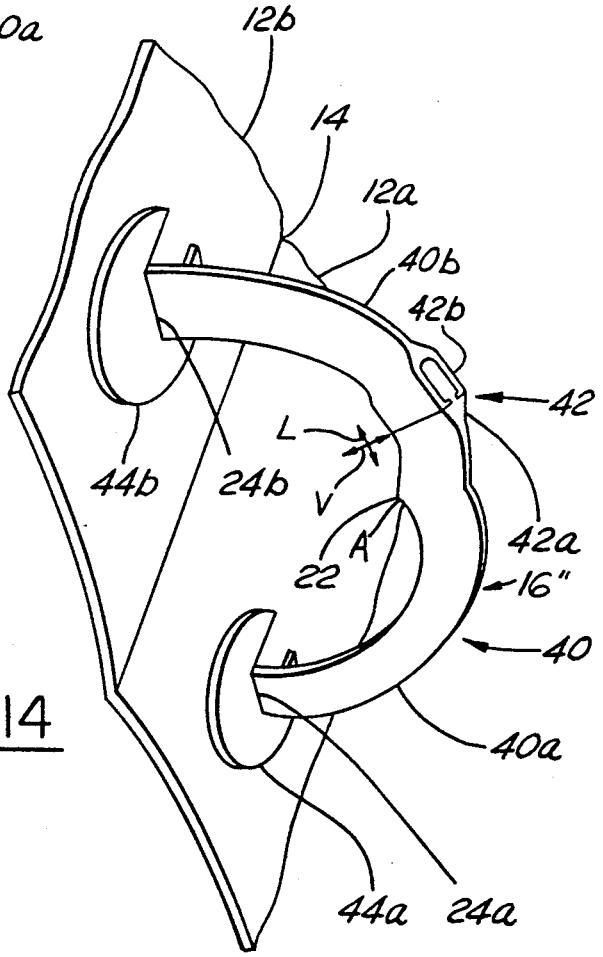
FIG. 14 is a perspective view of an embodiment of the foldable ring having two ring sections mutually selectively releasably connected adjacent the ring apex.

FIGS. 14 and 15 disclose yet another foldable ring structure. In this embodiment, the foldable rings 16'' are constructed of a two section ring portion 40 having a connector 42. A first ring section 40a terminates in a male connector 42a, and the second ring section 40b terminates in a female connector 42b. The male connector 42a includes a male portion 50 connected integrally with the first ring section 42a whereat is located a pair of slots 52 on either side thereof, each slot being oriented in the transverse axis T. The female connector 42b includes a female portion 46 integrally connected with the second ring section 42b and is terminally defined by a pair of transversely oriented bosses 48. The bosses 48 are structured to slide into the slots 52 when the male portion 50 slid transversely into the female portion 46. As will be understood from FIG. 14, when this transverse sliding movement is performed, the bosses interferingly engage with the slots so as to prevent the two ring sections 40a, 40b from mutually separating along the longitudinal axis L, wherein the longitudinal axis is parallel with respect to a tangent to the ring portion at the connector 42. It is preferred that a regulating structure control the placement of the male connector with respect to the female connector so that the ring portion everywhere presents a smooth surface with respect to the holes of the pages. An example of such a structure is shown in FIG. 15, wherein complementary wedge shaping is used to regulate transverse travel of the male connector 42a relative to the female connector 42b in order to provide properly aligned seating therebetween.

The foot portions 44a, 44b integrally connected with respective ring sections 40a, 40b , and the foot portions connect with respective side members 12a, 12b. Basal folds 24a, 24b are preferably provided as discussed hereinabove with respect to the other embodiments of the foldable rings 16, 16'. An apex fold 22 is provided at the apex A of the two section ring portion 40, and the connector 42 is offset on one side or the other with respect to the apex fold so as not to interfere with its foldability, the left side (as shown) being preferred.

A first tapered portion 54 adjacent the female connector 42b and a second tapered portion 56 adjacent the male connector 42a provide a smooth transition between the thickness of the connector 42 (which is preferably much less than the diameter of the holes 20) and the thickness of the first and second ring sections 42a, 42b (which is the same thickness T in FIG. 3).

In operation, when a user desires to add or delete pages from the foldable rings 16'', the male connector 42a is transversely moved with respect to the female connector 42b so that the first and second ring sections 40a, 40b are separated from each other. After page adjustment has been made, the male connector is moved transversely with respect to the female connector so that the male portion 50 is again seated into the female portion 46. Pages may now be manipulated on the foldable rings 16'' in the manner used with respect to conventional ring binders, and the binder-folder may be closed and the foldable rings will thereupon fold flatly in the manner discussed hereinabove.

To those skilled in the art to which this invention appertains, the above described preferred embodiment may be subject to change or modification. For instance, while pages in the form of sheets of paper are a preferred hole punched item to be used in connection with the binder-folder 10, more-or-less anything having hole punching can be used. Also, while the preferred structure of the present invention is a binder-folder as described hereinabove, the foldable rings can be used in connection with any kind of holder for pages. Further, while foldable rings constructed of a flexible sheet plastic are preferred, it is possible to construct the foldable rings from rigid or semi-rigid material which is hinged (as for example by a living hinge) at various selected locations, particularly at the apex fold and the two basal folds. Such change or modification can be carried out without departing from the scope of the invention, which is intended to be limited only by the scope of the appended claims.

What is claimed is:

1. A binder-folder for holding pages, the pages having at least one hole, said binder-folder comprising:

a first side member;

a second side member foldably connected to said first side member along a centerline therebetween;

at least one foldable ring, said at least one foldable ring being connected with said first and second side members, each foldable ring of said at least one foldable ring comprising:

a ring portion having a substantially semi-circular shape, said ring portion being constructed of a material that is selectively foldable, said ring portion having a first end and a second end, said ring portion having a predetermined thickness, said ring portion having a predetermined width;

first foot means connected with said first end of said ring portion for providing connecting structure of said foldable ring with respect to one of said first and second side members; and second foot means connected with said second end of said ring portion for providing connecting structures of said foldable ring with respect to the other of said first and second side members; and foldable ring connection means for selectively connecting said first foot means to one of said first and second side members and for selectively connecting said second foot means to the other of said first and second side members, wherein said ring portion is oriented transversely with respect to said centerline;

wherein said first and second members are foldable along said centerline between a closed orientation and an open orientation, further wherein said at least one foldable ring selectively folds between an unfolded configuration when said first and second members are at said open orientation to a folded configuration when said first and second members are at said closed orientation;

whereby the pages are held with respect to the binder-folder by said at least one foldable ring threading respectively through the at least one hole of the pages.

2. The binder-folder of claim 1, wherein said at least one foldable ring comprises at least two foldable ring each mutually separated a predetermined distance along said centerline.

3. The binder-folder of claim 1, wherein said predetermined thickness is at least an order of magnitude less than said predetermined width, wherein further said ring portion is constructed of a flexible material, said ring portion having an apex, said foldable ring having an apex fold at said apex of said ring portion, said foldable ring having a first basal fold adjacent said first end of said ring portion, said foldable ring further having a second basal fold adjacent said second end of said ring portion, wherein said selective folding of said foldable ring substantially occurs at said apex fold, said first basal fold and said second basal fold.

4. The binder-folder of claim 3, wherein said at least one foldable ring comprises at least two foldable rings each mutually separated a predetermined distance along said centerline.

5. The binder-folder of claim 1, wherein said foldable ring connection means provides a selectively releasable connection of at least one of said first and second foot means with respect to said first and second side members.

6. The binder-folder of claim 5, wherein said predetermined thickness is at least an order of magnitude less than said predetermined width, wherein further said ring portion is constructed of a flexible material, said ring portion having an apex, said foldable ring having an apex fold at said apex of said ring portion, said foldable ring having a first basal fold adjacent said first end of said ring portion, said foldable ring further having a second basal fold adjacent said second end of said ring portion, wherein said selective folding of said foldable ring substantially occurs at said apex fold, said first basal fold and said second basal fold.

7. The binder-folder of claim 6, wherein said foldable ring connection means comprises:

a base member connected with each of said first and second side members;

a first pocket-slot in said base member proximate said centerline and adjacent one of said first and second side members; and a second pocket-slot in said base member proximate said centerline and adjacent the other of said first and second side members;

wherein said first foot means is slidably engagable with respect to said first pocket-slot, and said second foot means is slidably engagable with respect to said second pocket-slot.

8. The binder-folder of claim 7, wherein said at least one foldable ring comprises at least two foldable rings each mutually separated a predetermined distance along said centerline.

9. The binder-folder of claim 5, wherein said foldable ring connection means comprises a two component releasable fastener means having a first component and a second component which are mutually selectively connectable, wherein said first component thereof is connected to at least one of said first and second side members and said second component thereof is connected to at least a respective one of said first and second foot means.

10. The binder-folder of claim 9, wherein said at least one foldable ring comprises at least two foldable rings each mutually separated a predetermined distance along said centerline.

11. The binder-folder of claim 1, wherein said ring portion further comprises:

a first ring section having a first terminal end;

a second ring section having a second terminal end; and connector means for selectively connecting said first terminal end of said first ring section with respect to said second terminal end of said second ring section so as to form said ring portion.

12. The binder-folder of claim 11, wherein said predetermined thickness is at least an order of magnitude less than said predetermined width, wherein further said ring portion is constructed of a flexible material, said ring portion having an apex, said foldable ring having an apex fold at said apex of said ring portion, said foldable ring having a first basal fold adjacent said first end of said ring portion, said foldable ring further having a second basal fold adjacent said second end of the said ring portion, wherein said selective folding of said foldable ring substantially occurs at said apex fold, said first basal fold and said second basal fold.

13. The binder-folder of claim 12, wherein said connector means is located at other than at said apex of said ring portion.

14. The binder folder of claim 13, wherein said first and second ring sections have said predetermined thickness, further wherein said connector means comprises:

a female connector connected with said first terminal end of said first ring section said female connector having a second predetermined thickness, a male connector connected with said second terminal end of said second ring section, said male connector having a third predetermined thickness, said male connector being structured to removably engage seatably with respect to said female connector so as to lock said first ring section with respect to said second ring section along a longitudinal axis, said longitudinal axis being oriented parallel with respect to a tangent to said ring portion at said connector means; and taper means for providing a smooth taper between said predetermined thickness of said first ring section and said second predetermined thickness of said female connector and for providing a smooth taper between said predetermined thickness of said second ring section and said third predetermine thickness of said male connector.

15. The binder-folder of claim 14, wherein said at least one foldable ring comprises at least two foldable rings each mutually separated a predetermined distance along said centerline.

16. A foldable ring for use in connection with with a holder of pages, said foldable ring comprising:

a ring portion having a substantially semi-circular shape, said ring portion having a first end and a second end, said ring portion having a predetermined thickness, said ring portion having a predetermined width;

foot means connected with said first end and said second end of said ring portion for providing connecting structure of said foldable ring with respect to the holder of pages; and foldable ring connection means for selectively connecting said foot means to said holder of pages.

17. The binder-folder of claim 16, wherein said predetermined thickness is at least an order of magnitude less than said predetermined width, wherein further said ring portion is constructed of a flexible material, said ring portion having an apex, said foldable ring having an apex fold at said apex of said ring portion, said foldable ring having a first basal fold adjacent said first end of said ring portion, said foldable ring further having a second basal fold adjacent said second end of said ring portion, wherein said foldable ring is selectively foldable substantially at said apex fold, said first basal fold and said second basal fold.

18. The binder-folder of claim 17, wherein said foldable ring connection means provides a selectively releasable connection of said foot means with respect to said holder of pages.

19. The binder-folder of claim 17, wherein said ring portion further comprises:

a first ring section having a first terminal end;

a second ring section having a second terminal end; and connector means for selectively connecting said first terminal end of said first ring section with respect to said second terminal end of said second ring section so as to form said ring portion.

20. The binder folder of claim 19, wherein said first and second ring sections have said predetermined thickness, further wherein said connector means comprises:

a female connector connected with said first terminal end of said first ring section said female connector having a second predetermined thickness, a male connector connected with said second terminal end of said second ring section, said male connector having a third predetermined thickness, said male connector being structured to removably engage seatably with respect to said female connector so as to lock said first ring section with respect to said second ring section along a longitudinal axis, said longitudinal axis being oriented parallel with respect to a tangent to said ring portion at said connector means; and taper means for providing a smooth taper between said predetermined thickness of said first ring section and said second predetermined thickness of said female connector and for providing a smooth taper between said predetermined thickness of said second ring section and said third predetermined thickness of said male connector.

* * * * *